US005427421A

United States Patent [19]

Hamaguchi

[11] Patent Number: 5,427,421

[45] Date of Patent: Jun. 27, 1995

[54] DOOR LOCK DEVICE WITH ONE-MOTION DOOR OPENING MECHANISM

[75] Inventor: Osamu Hamaguchi, Nirasaki, Japan

[73] Assignee: Mitsui Kinzoku Kogyo Kabushiki Kaisha, Tokyo, Japan

[21] Appl. No.: 111,510

[22] Filed: Aug. 24, 1993

[30] Foreign Application Priority Data

Aug. 25, 1992 [JP] Japan ..... 4-248655
Aug. 26, 1992 [JP] Japan ..... 4-250794
Aug. 26, 1992 [JP] Japan ..... 4-250795

[51] Int. Cl.[6] ..... E05C 3/26

[52] U.S. Cl. ..... 292/216; 292/DIG. 23; 292/DIG. 27

[58] Field of Search ..... 292/216, DIG. 23, 225, 292/DIG. 27; 74/480 R, 502.6

[56] References Cited

U.S. PATENT DOCUMENTS 3,190,682 6/1965 Fox et al. .
3,602,019 8/1971 Kazaoka ..... 292/216
4,756,563 7/1988 Garwood et al. ..... 292/216
5,035,452 7/1991 Rogers .

*Primary Examiner*—Peter M. Cuomo
*Assistant Examiner*—Gary Estremsky
*Attorney, Agent, or Firm*—Browdy and Neimark

[57] ABSTRACT

A door lock device has a one-motion door opening mechanism. The door lock device comprises a latch mechanism consisting of a latch and a ratchet preventing the latch from reverse-rotating, an outer opening lever, a lock lever, a link operatively placed between the outer opening lever and the lock lever, an inner opening lever connected to the inside opening handle of the vehicular door. The link and the inside opening handle are so connected that the link moves apart from the pressing piece of the ratchet when the inside opening handle excessively rotates. Consequently, when it is at the locked condition and the inside opening handle is operated to open the door, the ratchet is disengaged from the latch and the link is pressed by the pressing piece displacing it to the unlocked position. When the inside opening handle is excessively rotated, the link moves apart from the pressing piece.

5 Claims, 11 Drawing Sheets

DOOR LOCK DEVICE WITH ONE-MOTION DOOR OPENING MECHANISM

TECHNICAL FIELD OF THE INVENTION

The present invention relates to a door lock device, in particular, to a door lock device provided with a mechanism (hereinafter referred to as a one-motion door opening mechanism) made to be able to actuate a door opening operation and an unlock condition when an inside opening handle for opening the door operates to open the door even though the door lock device is at its locked condition.

PRIOR ART

The publicly known Japan Patent laid-open specification No. Sho 58-150673 discloses a conventional door lock device, as shown in FIG. 13 and FIG. 14 of this specification, comprising a latch mechanism consisting of a latch and a ratchet A engageable with the latch preventing the latch from reverse-rotating, an outer opening lever C connected to the door-outside opening handle B, a lock lever D for exchanging the lock device between its lock condition and a unlock condition, a link E installed between the outer opening lever C and the lock lever D, said link E being adapted to be moved between its locked position and its unlocked position by the lock lever D and having an engagement portion G which is engaged with a cancel lever F integrated with the ratchet A when the link E is placed at its unlocked position and disengaged when the link E is at its locked position, and an inner open lever I connected to an inside open handle H and provided with an engagement portion J enabling to rotate the cancel lever F, said cancel lever F having a pressing piece K enabling to displace the link to its unlock position, whereby when the link is at its locked condition the inside open handle H operates to open the door, the ratchet A is disengaged from the latch and the link E is pressed by the pressing piece K of the cancel lever F and displaced to its unlocked condition.

According to the conventional link above-mentioned, it rotates or displaces by the distance obtained by adding a surplus displacement distance to the rotational displacement distance between its locked position and its unlocked position. This surplus rotational volume, is a by-product resulted from the provision of the one-motion door opening mechanism and it is not produced when such one-motion door opening mechanism is not provided.

The reason why such surplus rotation happens will be apparent from the following statement. As shown in FIG. 14 depicting the conventional door opening device, when the inside opening handle H opens the door, the inner opening lever I pushes a protrusion L of the cancel lever F so as to rotate it counterclockwise. Then, the ratchet A integrately attached to the cancel lever F also rotates and as a result the ratchet A is disengaged from the latch resulting in an opening of the door. Simultaneously, the cancel lever F rotates once, a protrusion K pushes the link E so as to displace the link E to the position shown by imaginary lines. Thus, the door opening operation and an exchanging to its unlocked position are done at a time. Because the door opening operative distance of the inside open handle H is used to set at a volume or distance larger than the necessary distance to open the door, once the inside open handle H is pulled fully and the ratchet A overly rotates by a considerable distance after it is disengaged from the latch.

As described above, when the ratchet A rotates with a surplus, the cancel lever F too rotates in a surplus rotation together with the ratchet A integrated with the cancel lever F, thereby the link E is pressed to the left and moves more than the position shown by imaginary lines of the link E. The movement of the link E over its position shown by the imaginary lines is a surplus rotation of the link E.

In order to solve the problem above, it is possible to set or design the link E so as to return just at its unlocked position after the ratchet A rotates by the surplus distance. In this case, when the volume or distance of operation of the inside opening handle H is not sufficient, the ratchet A doesn't rotate excessively resulting in a possibility of a dangerous opening of the door even the link E doesn't return to its unlocked position.

Consequently, according to the known conventional door lock device provided with a one-motion door opening mechanism, its link must be installed in a wide space and it is impossible to install it in a narrow space.

To improve the crime preventability of cars, a link can be installed in a narrow space increasing theft deterrence.

PURPOSE OF THE INVENTION

It is the purpose of the present invention to provide a door lock device with a one-motion door opening mechanism, whose link can be installed in a narrow space by decreasing an excessive or surplus rotation of the link as much as possible.

In order to attain such purpose, the link of the door lock device is adapted to move along a direction escaping or deviating from the ratchet after the link is returned to its unlocked position by the one-motion door opening mechanism.

EMBODIMENTS

Figure 1:
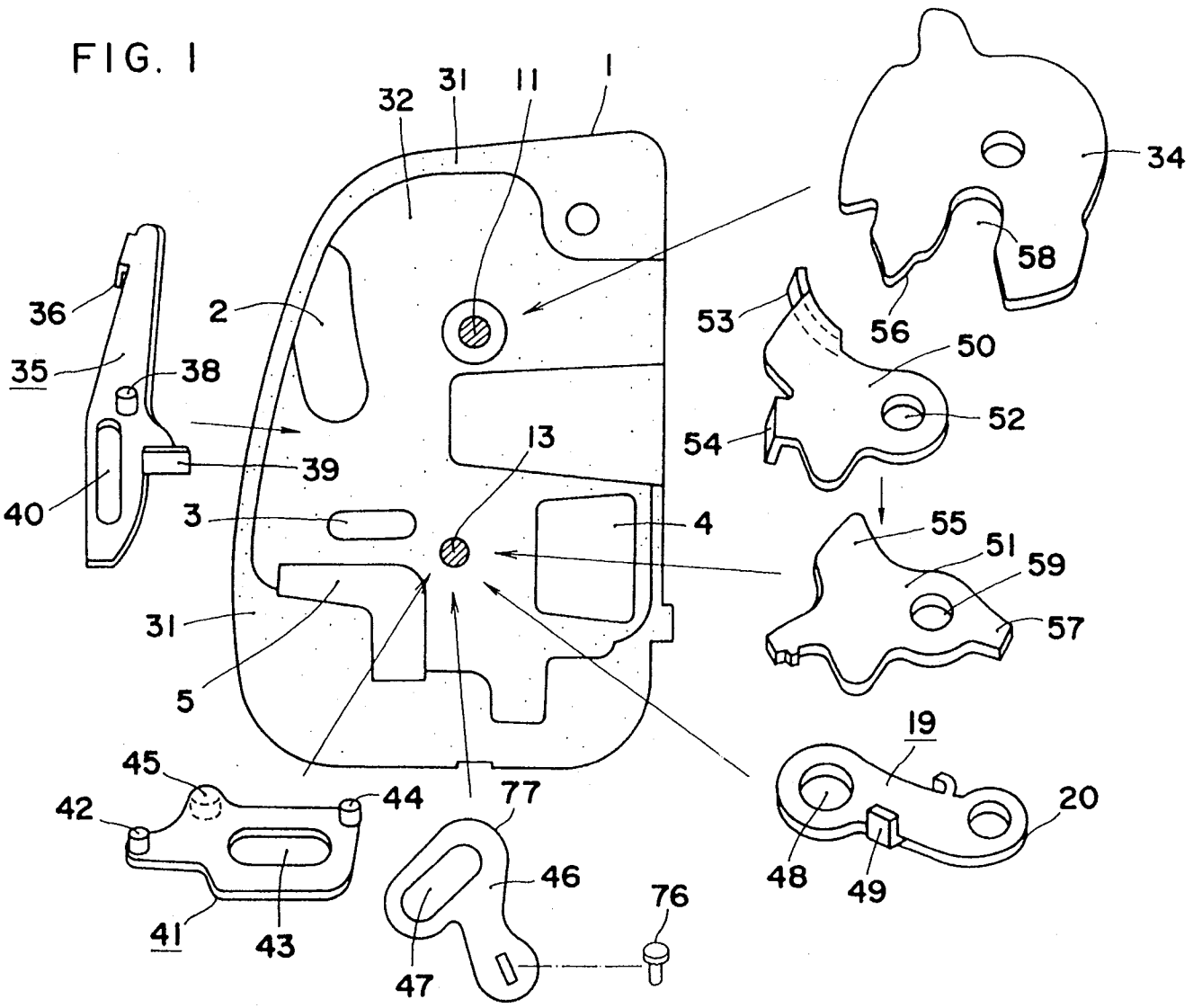
FIG. 1 is an exploded view of the door lock device of the first embodiment of the present invention.
Figure 2:
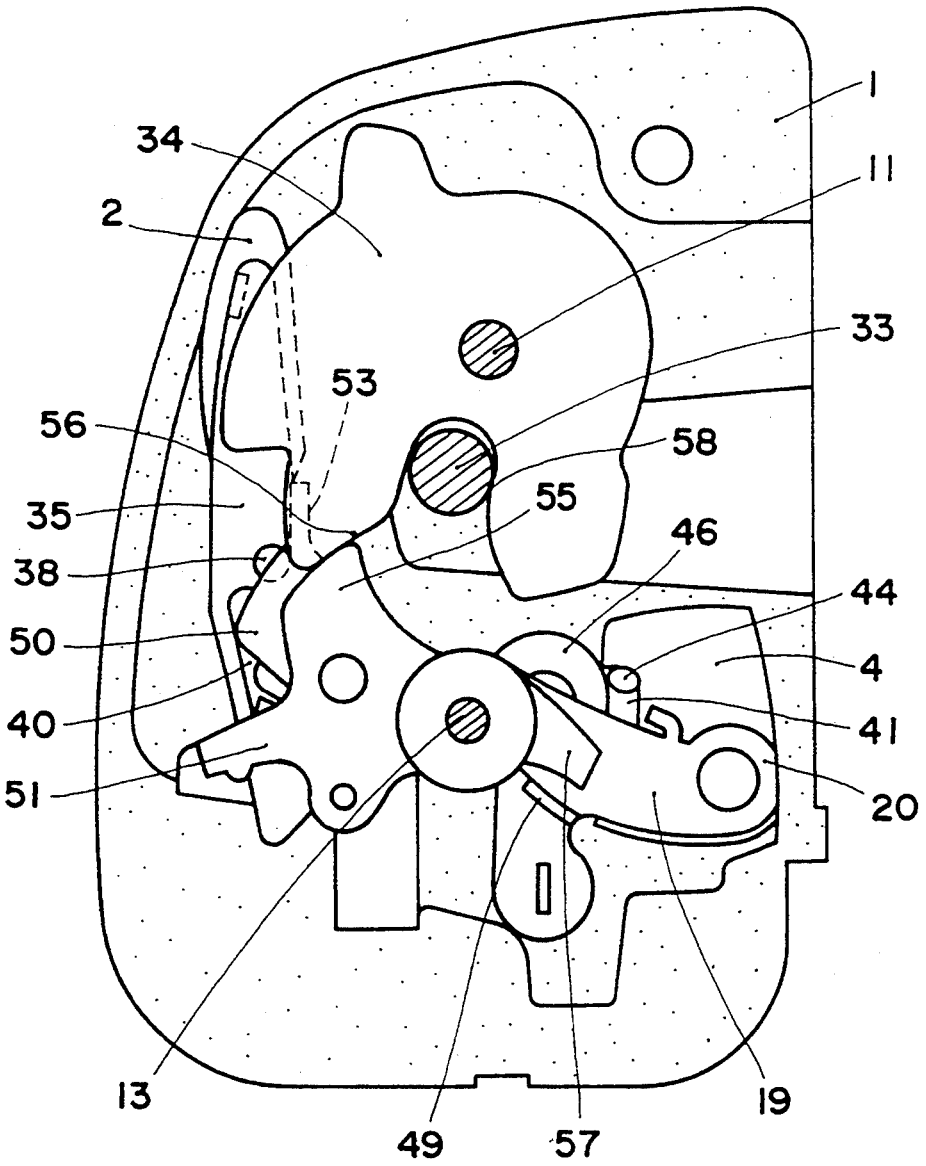
FIG. 2 is a front view of the door lock device shown in FIG. 1.
Figure 3:
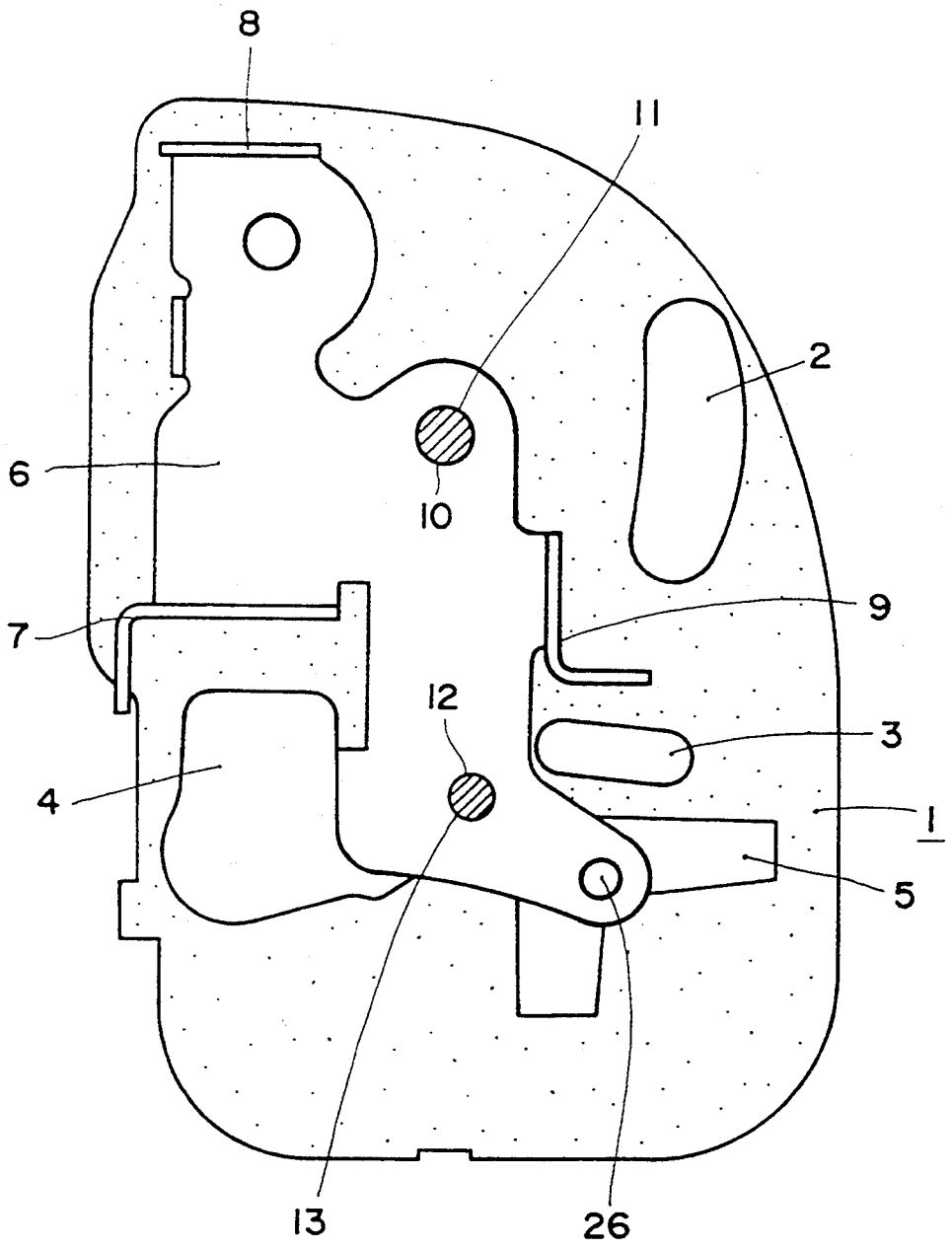
FIG. 3 is a rear view of a body of the door lock device and a back plate attached to the body.

The lock device body 1 made of synthetic resin of the door lock device according to the present invention has a side wall 31 formed along the circumference of the body 1 as shown in FIG. 1. A dent portion 32 is formed in the side wall 31. The body 1 has an upper latch shaft 11 and a lower ratchet shaft 13. Both the shafts 11 and 13 pass through the lock device body 1. A latch 34 adapted to engage with a striker 33 (FIG. 2) attached to the car body is rotatably installed in the dent portion 32 through the latch shaft 11.

Figure 8:
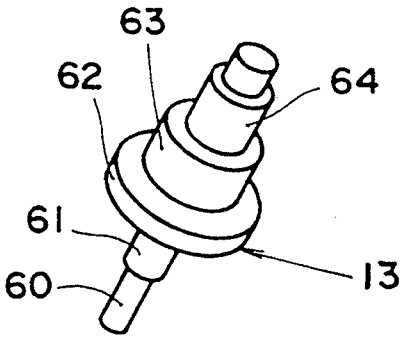
FIG. 8 is a perspective view of the ratchet shaft.
Figure 9:
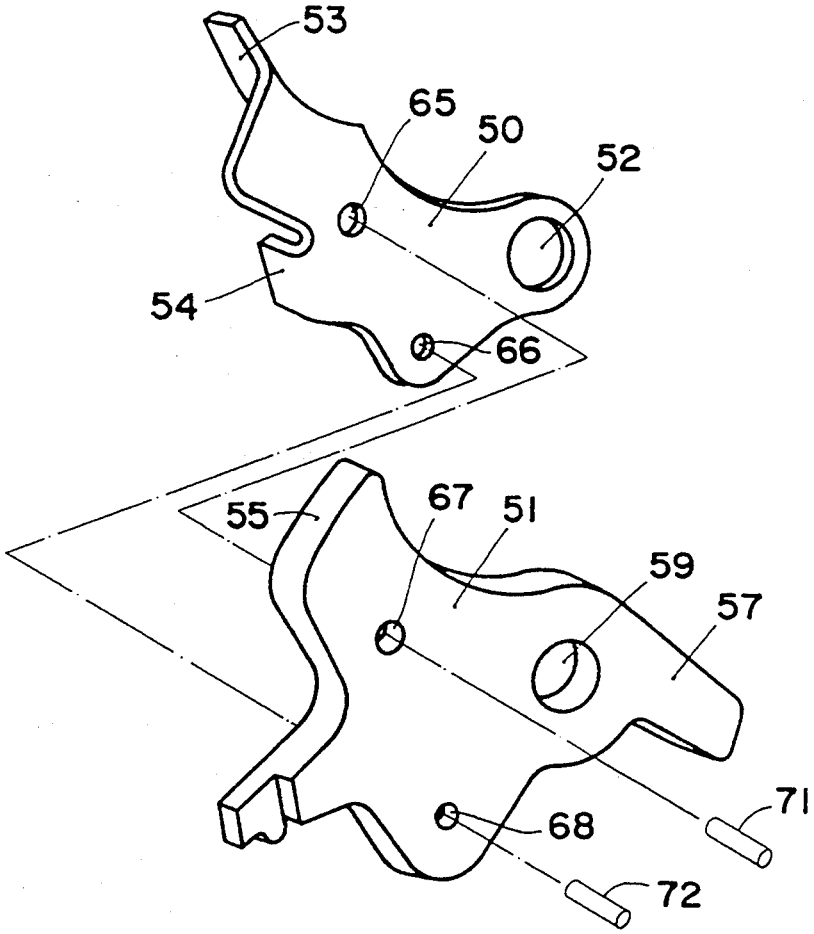
FIG. 9 is a perspective view of the cancel lever and the ratchet.
Figure 10:
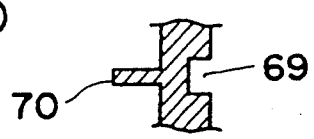
FIG. 10 is a view showing an example of a pin.

At a position lower than that of the latch 34, a ratchet 51 is installed so as to engage with a stepped portion 56 of the latch 34 in order to prevent the latch 34 from reverse-rotating. A cancel lever 50 is fixed to the ratchet 51 so as to make a first portion 64 (FIG. 8) of the ratchet shaft 13 rotatable in a shaft hole 59 of the ratchet 51 and a shaft hole 52 of the cancel lever 50. The ratchet 51 and the cancel lever 50 can be fixed at will. According to the embodiment of the door lock device, the ratchet 51 has pin holes 67 and 68, and the cancel lever 50 has a pin holes 65 and 66, respectively formed therein. Pins 71 and 72 are inserted through these pin holes and caulked. It is possible to stamp press the ratchet 51 or the cancel lever 50 as shown in FIG. 10 in order to make pins to integral on the ratchet 51 or cancel lever 50.

When the stepped portion 56 of the latch 34 engages with a claw 55 of either the ratchet 51, the inside opening handle 73 of the door presses a release piece 57 of the ratchet 51 or the outside opening handle 74 of the door presses an engagement piece 54 of the cancel lever 50 in order to rotate the ratchet 51 counterclockwise resulting in a disengagement of the claw 55 of the ratchet 51 from the latch 34 and a possibility of an opening of door. The operation above of the inside opening handle 73 or the outside opening handle 74 will be explained in detail below.

Figure 4:
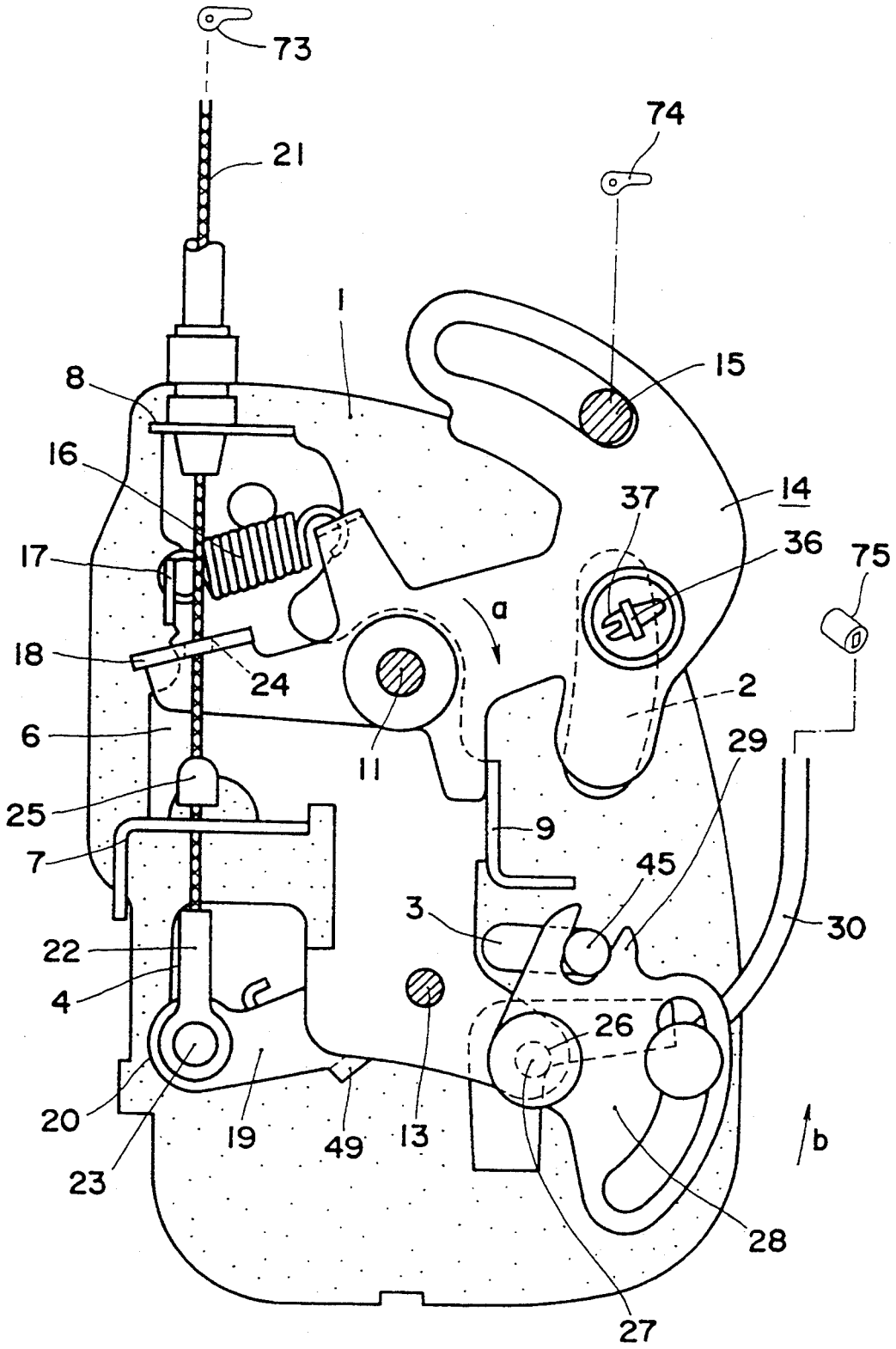
FIG. 4 is a rear view of the door lock device.

A link 35 extending vertically when installed on the body 1 is installed at the left side of the dent portion 32. A protrusion 36 extending through an opening 2 of the lock device body 1 is formed at an upper portion of the link 35. As shown in FIG. 4, the protrusion 36 is connected to the outer opening lever 14 through a connector 37. The opening lever 14 is rotatably held on the latch shaft 11. A rod 15 extending to the outside opening handle 74 is connected to one end portion of the opening lever 14. The link 35 has an engagement portion 39 engageable with an engagement piece 54 formed on the cancel lever 50. When the outside opening handle 74 makes the opening lever 14 rotate in order to lower the link 35, the engagement portion 39 abuts or engages with the engagement piece 54 and makes the cancel lever 50 and the ratchet 51 rotate resulting in a possibility of opening of the door.

Figure 5:
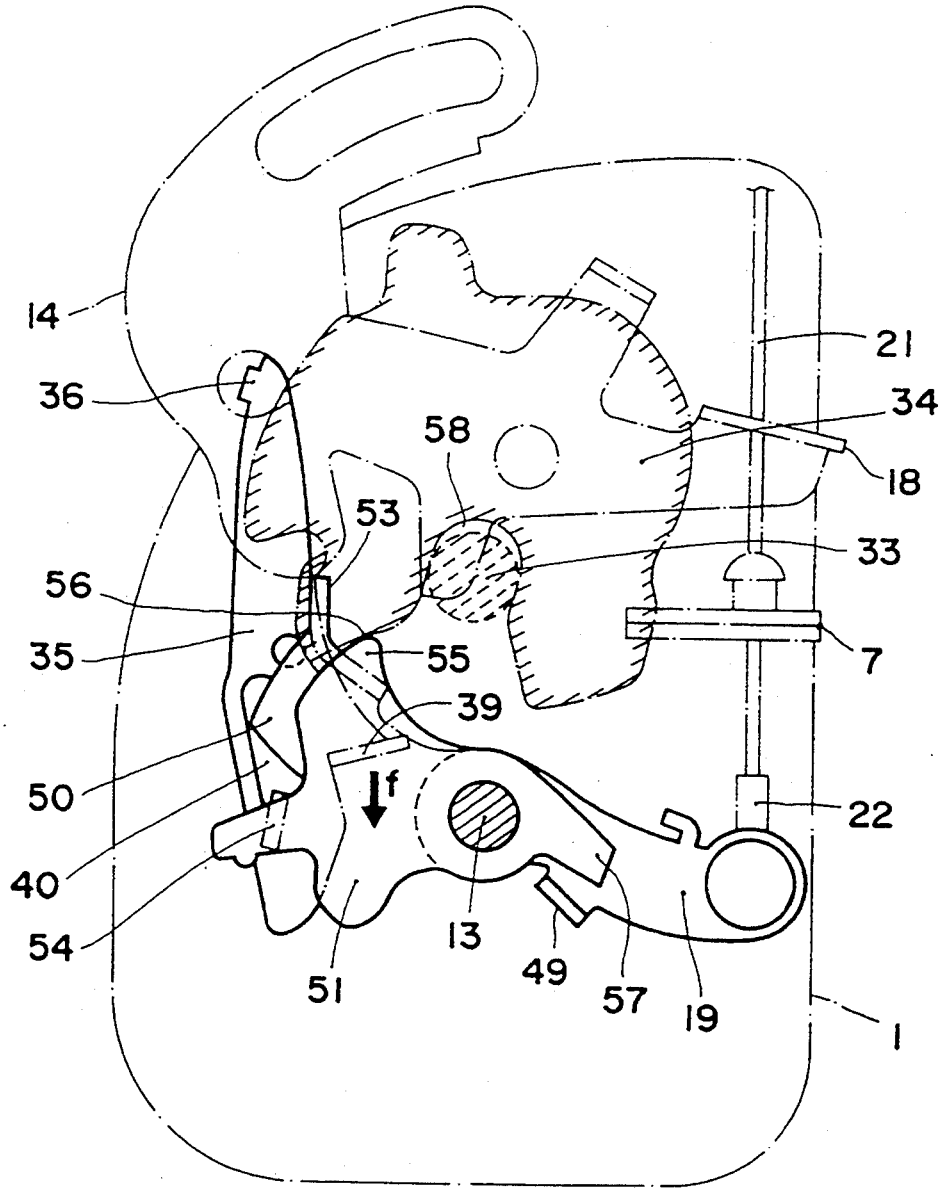
FIG. 5 is a front elevation showing the door lock device locked.

At a position lower than the link 35, a movable plate 41 is installed. An engagement pin 42 is so formed at an end portion of the movable plate 41 to engage the vertical slit 40 of the link 35. The movable plate 41 has an oval opening 43 provided with its horizontal long axis when the oval opening 43 is installed on the lock device body 1. The oval hole 43 is held by the second portion 61 (FIG. 8) of the ratchet shaft 13. An engagement pin 45 extending to the back side of the lock device body 1 through the opening portion 3 of the body 1 is installed on the back side of the movable plate 41. The engagement pin 45 is indirectly connected to a key cylinder 75 described later in detail. Operation of the key cylinder 75 makes the movable plate 41 move to the right and to the left. When the movable plate 41 moves, the link 35 swings between its locked position and the unlocked position around the protrusion 36. As shown in FIG. 5, when the engagement portion 39 of the link 35 and the engagement piece 54 are separated from each other along the left and right line, the lock device is at its locked condition. When the engagement portion 39 and the engagement piece 54 are faced to each other, it is at its unlocked condition.

As described above, the condition of the lock device is determined or exchanged according to the particular position of the link 35, so that when the link 35 is installed at a position which is difficult for a thief to approach or access, the probability of theft is decreased. In order to prevent such theft, the link 35 of the door lock device according to the present invention is accommodated in the dent portion 32 of the lock device body 1.

An oval hole 47 of the exchanging lever 46 adapted to revolve by an inside lock knob 76 engages with the second portion 61 of the ratchet shaft 13. When the exchange lever 46 is rotated by the knob 76 an end portion 77 of the exchange lever 46 presses the engagement pin 44 of the movable plate 41 and consequently the movable plate 41 moves.

A shaft hole 48 of the inner open lever 19 is rotatably held at the third portion 63 of the ratchet shaft 13. The inner opening lever 19 has a protrusion 49 engageable with a release piece 57 of the ratchet 51. The protrusion 49 is formed on the lever 19. A rotary end 20 of the inner opening lever 19 protrudes to the back side of the body 1 through the open portion 4 of the body 1. An end portion of the wire 21 extending to the inside opening handle 73 is connected to the protruded portion of the rotary end 20. As a result, when the handle 73 rotates the opening lever 19, the protrusion 49 directly presses the piece 57, without relation to the lock mechanism of the link 35, enabling to rotate the ratchet 51.

As described above, it is possible to disengage the ratchet 51 from the latch 34 by operation of the opening handle 74 from the outside of the door so as to make the link 35 press the engagement piece 54 of the cancel lever 50, or operate of the opening handle 73 from the inside of the door so as to make the opening lever 19 press the release piece 57 of the ratchet 51.

Figure 6:
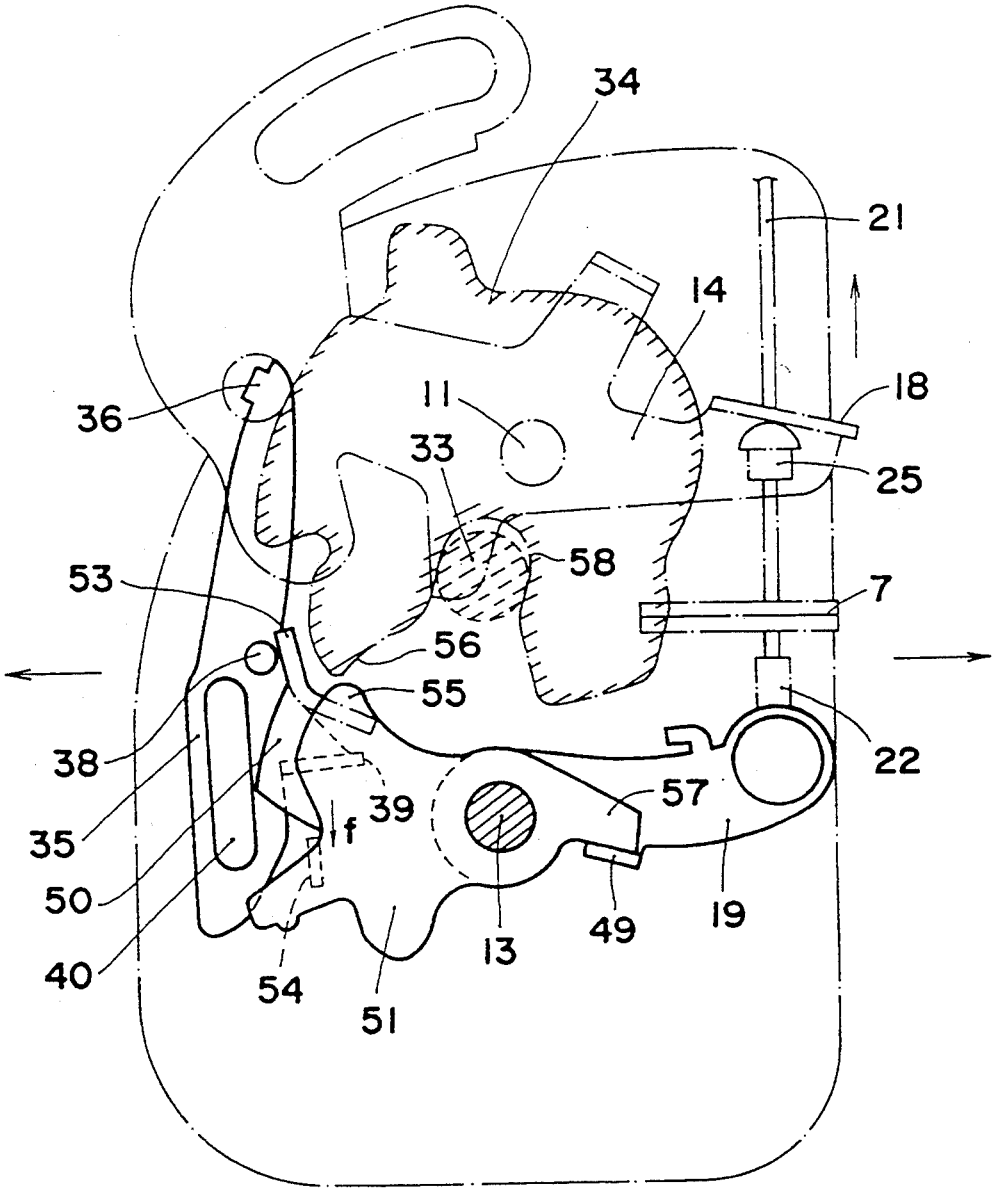
FIG. 6 is a front side elevation showing the door lock device after the inside opening handle is operated at a mid position.
Figure 7:
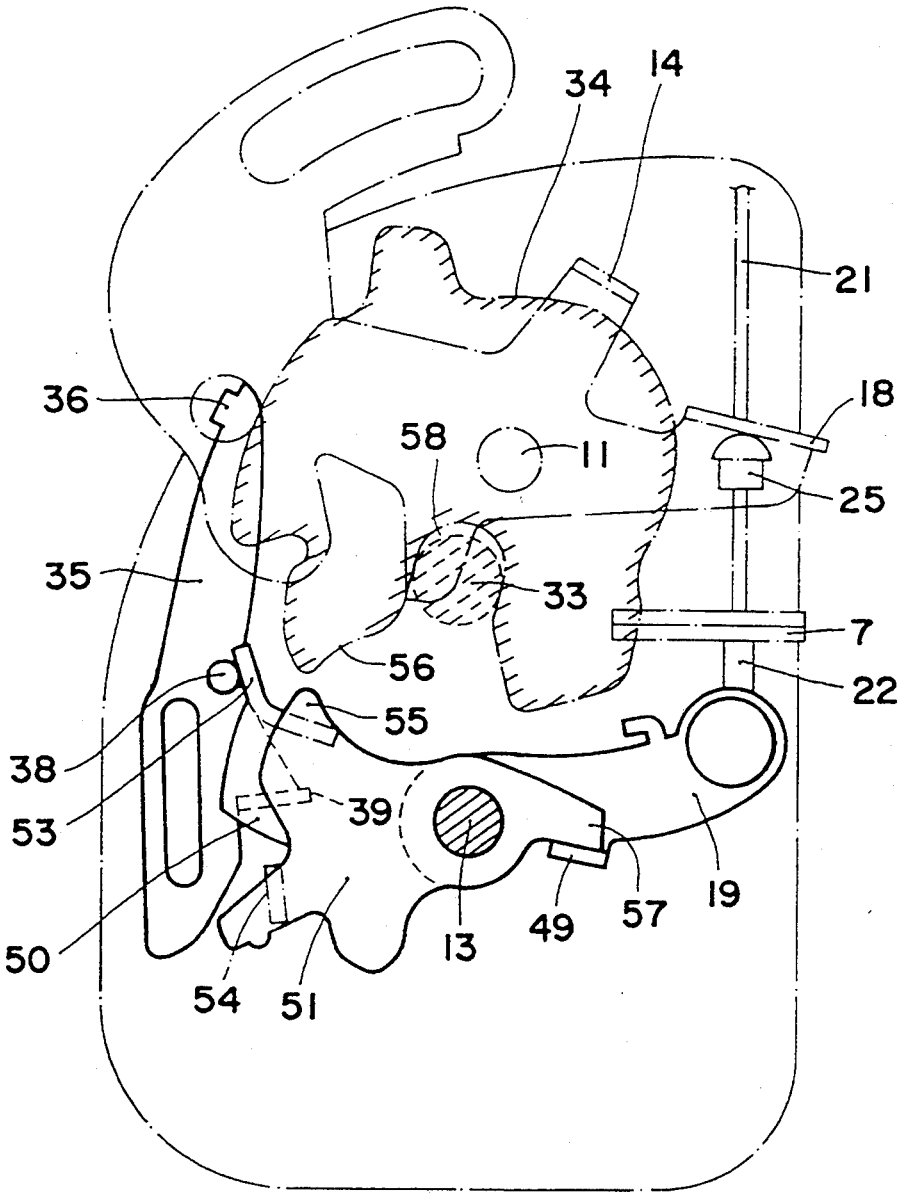
FIG. 7 is a front elevation of the device after the inside opening handle is fully operated.

A protrusion 38 is formed on the link 35 and a pressing piece 53 adapted to engage with the protrusion 38 is formed on the cancel lever 50. As shown in FIG. 5 to FIG. 7, when the engagement portion 39 and the engagement piece 54 are separated from each other, the link 35 is at its locked condition. The inside opening handle 73 rotates the inner opening lever 19 so as to rotate the ratchet 51 and the cancel lever 50 (not shown in FIGS. 5 to 7) integrated with the ratchet 51, the pressing piece 53 of the cancel lever 50 engages with the cancelling protrusion 38 of the link 35 to move the link 35 to the left and displace it to its unlocked position shown in FIG. 6. In other words, it is possible to disengage ratchet 51 from the latch 34 as the link 35 is returned to the unlocked position if the inside opening handle 73 is operated during a locked condition of the lock device of the present invention.

As shown in FIG. 30 a back plate 6 made of metal is attached to a back side of the lock device body 1. A first flange 7 and a second flange 8 facing to each other are integrally formed on the back plate 6. The first flange 7 is placed lowered than the second flange 8 and an opening portion 4 of the body 1 is placed under the first flange 7.

The outer opening lever 14 is rotatably held on the latch shaft 11 extending through the body 1 to its rear side. As shown in FIG. 4, the opening lever 14 is urged counterclockwise by a spring 16 installed in tension between the lever 14 and the protrusion 17 of the back plate 6. The opening lever 14 has a bent portion 18. The bent portion 18 is formed on the left end of the opening lever 14 and placed between the first flange 7 and the second flange 8.

The wire 21 extending to the inside opening handle 73 passes through the second flange 8, bent portion 18, and first flange 7. A fixture 22 at a lower end of the wire 21 is attached to a rotary end 20 of the inner opening lever 19. When the inside opening handle 73 operates to open the door, the wire 21 rises until the fixture 22 of the wire 21 strikes a lower face of the first flange 7. It is noted that a rod can be employed in place of the wire 21.

A pressing member 25 is so attached to the wire 21 at a position between the first flange 7 and the bent portion 18. When the wire 21 is raised, the pressing member 25 strikes the bent portion 18 before the fixture 22 of the pressing member 25 strikes the first flange 7. As a result, the outer opening lever 14 rotates against elasticity of the spring 16. The pressing member 25 and the bent portion 18 are adapted to engage with each other when a door opening operation of the inside open handle 73 rising the wire 21 reaches an over-stroke region. Consequently, when the inside opening handle 73 opens the door, the inner opening lever 19 rotates, the claw 55 of the ratchet 51 is disengaged from the stepped portion 56 of the latch 34. Simultaneously, the pressing piece 53 of the cancel lever 50 presses the protrusion 38 of the link 35 returning the link to its unlocked position. Then, when the inside opening handle 73 is excessively operated, accordingly the ratchet 51 and the cancel lever 50 excessively rotate. However, the link 35 is not pressed to the left over the unlocked position because the pressing member 25 makes the opening lever 14 rotate and the link 35 revolve in order to make the protrusion 38 of the link 35 move so as to be deviated from the pressing piece 53.

A lock lever 28 is rotatably attached at the lower end portion of the back plate 6 through a shaft 27. The lock lever 28 is connected to the key cylinder 75 through the rod 30. The lock lever 28 has a forked portion 29 adapted to engage with the engagement pin 45 extending through the opening portion 3 of the body 1 to the back side of the body 1. Consequently, when the key cylinder 75 makes the lock lever 28 rotate, the forked portion 29 engages with the engagement pin 45 moving the movable plate 41 transversely resulting in an exchange of the link 35 between its locked position and unlocked position.

In addition, the lock lever 28 exchanges selectively its position between the locked position and the unlocked one by means of an over-center or flip-flop spring (not shown). The lock lever engages with a stopper after the lock lever stays at its one position of the locked and the unlocked. As a result, also the link 35 connected to the lock lever 28 through the movable plate 41 is stayed at its one position of the locked and the unlocked.

Figure 11:
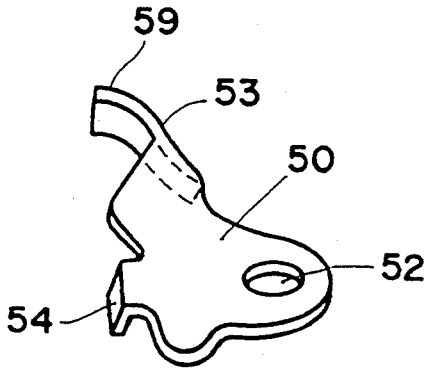
FIG. 11 is a perspective view of the cancel lever provided with a pressing piece according to the second embodiment.
Figure 12:
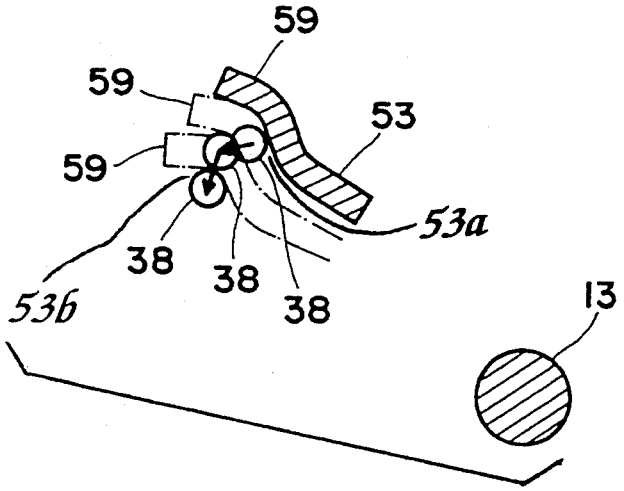
FIG. 12 is an operative explanation of the pressing piece of the second embodiment.
Figure 13:
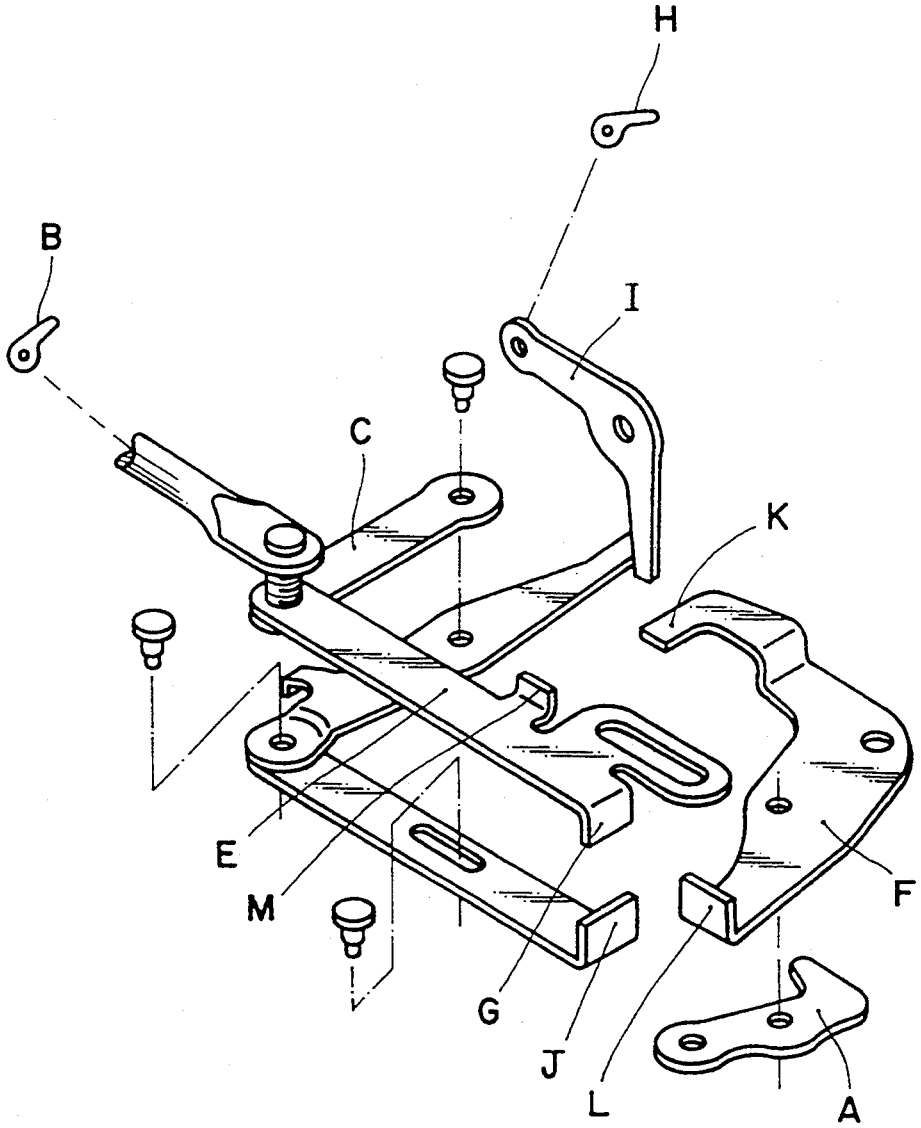
FIG. 13 (PRIOR ART)
FIG. 13 is a perspective view of the conventional door lock device.
Figure 14:
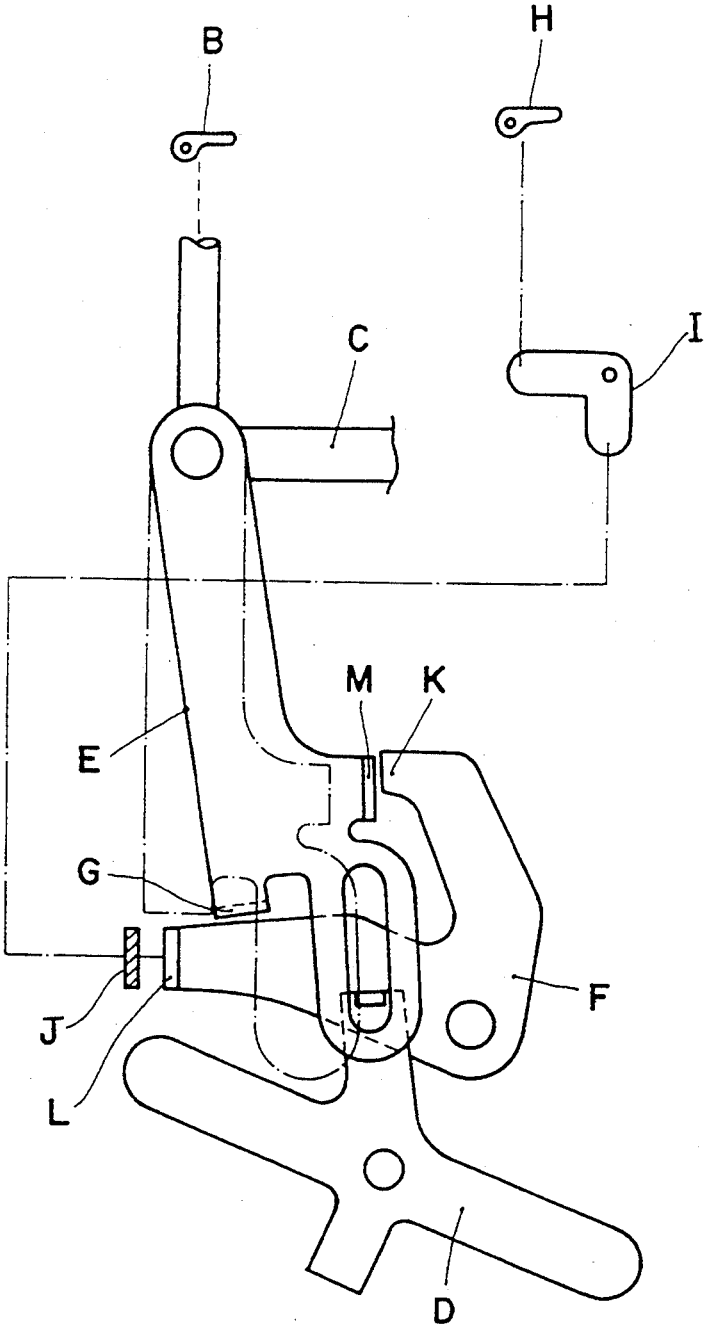
FIG. 14 (PRIOR ART)
FIG. 14 is an operative explanation of the conventional door lock device.

FIG. 11 and FIG. 12 shows the second embodiment of the door lock device of the present invention. According to the second embodiment, the gist of the present invention resides in the shape of the pressing piece 53 of the cancel lever 50 instead of the installation of the pressing member 25 on the wire 21. That is, the pressing piece 53 of the lock device of the second embodiment consists of a first portion **53*a* of generally straight and a second portion 53*b* formed on the front end side of the first portion 53*a*. The second portion 53*b* has a shape of a mountain covering the protrusion 38. As a result, when the door opening operation rotates the cancel lever 50, the first portion 53*a* presses the protrusion 38 of the link 35 displacing the link 35 to its unlocked position. When the cancel lever 50 excessively rotates after that, the first portion 53*a* is left from the protrusion 38 and the second portion 53*b* engages with the protrusion 38 resulting in a downing of the second portion 53*b* without a left-movement of the link 35**.

It is possible to make the pressing piece 53 of the second embodiment of elastic material such as rubber. A preferable hardness of the rubber to make the pressing piece 53 is determined so as to surely return the link 35 to its unlocked position after the pressing piece 53 engages with the protrusion 38 of the link 35 and elastically deform failing to further move the link 35 after the link 35 returns to its unlocked position.

An operation of the door lock device of the second embodiment will be explained.

When the lock device is at its locked condition as shown in FIG. 5, a door opening operation of the outside opening handle 74 rotates the outer opening lever 14 and lowers the link 35, but the engagement portion 39 of the link 35 fails to strike the engagement piece 54 of the cancel lever 50. Consequently, the cancel lever 50 and the ratchet 51 integrated with the lever 50 fails to move not enabling to open the door.

However, when the inside opening handle 73 carries out its door opening operation even when the lock device is at its locked condition as shown in FIG. 5, it is possible to open the door as will be described below.

When a door opening operation of the inside opening handle 73 raises the wire 21, the inner opening lever 19 rotates counterclockwise around the ratchet shaft 13, and the protrusion 49 of the opening lever 19 engages with the release piece 57 rotating counterclockwise the ratchet 51. Then, the ratchet 51 and the cancel lever 50 integrated with the ratchet rotate counterclockwise, resulting in an engagement of the protrusion 53 of the cancel lever 50 with the pin of the link 35. Accordingly, the link 35 is pushed to the left and rotates around the protrusion 36 resulting in the condition shown in FIG. 6.

FIG. 6 shows the condition of the door lock device at the instance at which the claw 55 of the ratchet 51 leaves from the stepped portion 56 of the latch 34. In this condition, the link 35 displaces to its unlocked position in this position the engagement portion 39 of the link 35 faces the engagement piece 54 of the cancel lever 50. In addition, the fixture 22 of the wire 21 doesn't engage with the first flange 7 and the pressing member 25 just strikes the lower face of the bent portion 18 of the outer opening lever 14. By the way, when the link 35 displaces to the unlocked position of the lock device, an engagement of the slit 40 and the engagement pin 42 makes the movable plate 41 slide to the unlocked position, the engagement pin 44 of the movable plate 41 presses the end portion 77 of the exchange lever 46 rotating the lever 46. As a result, the inside lock knob 76 is at last moved to the unlocked position.

At the condition shown in FIG. 6, the various parts and members move as described above, so it is possible to simultaneously move the link 35 to the unlocked condition and carry out a door opening operation. It is noted that the ratchet 51 generally can leave from the latch 34 before reaching the end of the rotation. That is, the ratchet 51 can further rotate over the condition shown in FIG. 6. According to the first embodiment of the lock device, the wire 21 can rise before the fixture 22 of the wire 21 engages with the first flange 7. According to the excessive distance of rising of the wire, the ratchet 51 can rotate further from the condition shown in FIG. 6.

However, according to the conventional one-motion mechanism, when the ratchet excessively rotates, the link is given a force to excessively displace the link. Consequently, in case that the link can excessively displace, it is necessary to provide a space for the excessively moving link. In case that the link can not excessively displace, the force for excessively displacing the link moves forcibly the link of the lock device resulting in a possibility of breakage of some parts or members of the mechanism.

On the contrary, according to the first embodiment of the lock device of the present invention, when the wire 21 further rises from the condition of FIG. 6, the pressing member 25 engages with the bent portion 18 resulting in a rotation of the outer opening lever 14. When the outer opening lever 14 rotates, the link 35 connected to the outer opening lever 14 lowers deviating the pin 38 of the link 35 from the protrusion 53 of the cancel lever 50. Consequently, even though the cancel lever 50 excessively rotates, no force pressing the link to the left over its unlocked position is applied to the link 35 preventing the link 35 from excessive rotating and various parts and member of the lock device from being given excessive force.

Next, according to the second embodiment of the lock device, when a door opening operation of the inside opening handle 73 is done, the ratchet 51 rotates and is disengaged from the latch 34. The first portion 53*a* of the pressing piece 53 of the cancel lever 50 integrated with the ratchet 51 presses the protrusion 38 of the link 35 to the left returning the link 35 to its unlocked position. The operation above of the second embodiment is identical with that of the lock device according to the first embodiment of the lock device.

Then the inside opening handle 73 of the second embodiment excessively operates and the ratchet 51 and cancel lever 50 excessively rotate. In this excessive or surplus operation region of these members, the protrusion 38 of the link 35 engages with the second portion 53*b* of the pressing piece 53 and the link 35 only lowers without movement to the left side.

Additionally, in case that the pressing piece 53 is made of elastic material, if the ratchet 51 excessively rotates and the pressing piece 53 presses the protrusion 38 of the link 35, which has excessively rotated and returned to its unlocked position, to the left, the pressing force of the pressing piece 53 is absorbed by the elastically-deformed pressing piece 53 preventing various parts and members of the lock device from being applied with strong forces.

What is claimed is:

1. A door lock device having a one-motion door opening mechanism; comprising: a latch mechanism consisting of a latch engaging a striker fixed to a vehicular body and a ratchet engaging said latch in order to prevent the latch from reverse-rotating, an outer opening lever connected to an outside opening handle of a door, a lock lever for moving the door lock device between a locked position and an unlocked position, a link installed between said outer opening lever and said lock lever, said link being moved by the lock lever between the locked position and the unlocked position and having an engagement portion engaging said ratchet when the link is in the unlocked position and disengaged from said ratchet when the link is in the locked position, and an inner opening lever connected to an inside opening handle of the door, said inner opening lever engaging the ratchet to rotate the ratchet without any relation to the link, said ratchet having a pressing piece which displaces the link to the unlocked position of the link, wherein said link and the inside opening handle being operatively connected to move the link apart from the pressing piece of the ratchet when the inside opening handle is excessively rotated, wherein, when the inside opening handle is operated to open the door during the locked position of the lock device, the ratchet disengages from the latch and the link is pressed from the pressing piece of said ratchet displacing to the unlocked position, and when the inside opening handle is excessively rotated, the link moves apart from the pressing piece.

2. The door lock device having a one-motion door opening mechanism according to claim 1, wherein said inside opening handle and said inner opening lever are connected through a wire or rod and the wire or rod has a pressing member attached thereto so as to engage with the outer opening lever rotating said outer opening lever.

3. The door lock device provided with a one-motion door opening mechanism according to claim 1, wherein said lock device has a body provided with a dent portion formed on a front side of the lock device.

4. A door lock device provided with a one-motion door opening mechanism; comprising:

a latch mechanism consisting of a latch engaging a striker fixed to a vehicular body and a ratchet engaging said latch in order to prevent the latch from reverse-rotating, an outer opening lever connected to an outside opening handle of a door, a lock lever for moving the lock device between a locked position and an unlocked position, a link installed between the outer opening lever and the lock lever, said link being movable between the locked position and the unlocked position by said lock lever, said link sliding away from the striker when an inner opening lever is actuated and engaging the ratchet when the link resides in the unlocked position and the outer opening lever is operated to open the door, and to slide away from the striker when the inner opening lever is actuated and not engage the ratchet when the link is at the locked position, and the inner opening lever connected to the inside opening handle of the door, said inner opening lever engaging directly or indirectly with the ratchet so as to rotate the ratchet without any relation to said link, wherein, said ratchet has a pressing piece consisting of a first portion to displace said link to the unlocked position and a second portion formed at a front end portion of the first portion, wherein, when the lock device is at the locked position and the inside opening handle is operated to open the door, the ratchet is disengaged from the latch and the link is pressed by the first portion of the pressing piece displacing to the unlocked position, and when the inside opening handle is excessively rotated, the link engages with the second portion of the pressing piece so as to slide toward the door when opened.

5. A door lock device provided with a one-motion door opening mechanism; comprising:

a latch mechanism consisting of a latch on a door engaging a striker fixed to a vehicular body and a ratchet engaging said latch in order to prevent the latch from reverse-rotating, an outer opening lever connected to an outside opening handle of the door, a lock lever for moving the lock device between a locked position and an unlocked position.

a link installed between the outer opening lever and the lock lever, said link being movable between the locked position and the unlocked position by said lock lever, said link having an engagement portion engaging with the ratchet when the link is at the unlocked position, and not engaging with the ratchet when the link is at the locked position, and an inner opening lever connected to the inside opening handle of the door, said inner opening lever engaging directly or indirectly with the ratchet so as to rotate the ratchet without any relation with said link, wherein, said pressing piece is made of an elastic material, wherein, when the lock device is at the locked position and the inside opening handle is operated to open the door, the ratchet is disengaged from the latch and the link is pressed by said pressing piece displacing to the unlocked position, and when the inside opening handle is excessively rotated, the pressing piece is elastically deformed by engagement with the link.

* * * * *